US009715975B2

(12) United States Patent
Hsu

(10) Patent No.: US 9,715,975 B2
(45) Date of Patent: Jul. 25, 2017

(54) KEYSWITCH USING MAGNETIC FORCE TO RESTORE CAP POSITION

(71) Applicant: DARFON ELECTRONICS CORP., Taoyuan (TW)

(72) Inventor: Chien-Shih Hsu, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 15/173,703

(22) Filed: Jun. 5, 2016

(65) Prior Publication Data

US 2017/0186569 A1 Jun. 29, 2017

Related U.S. Application Data

(60) Provisional application No. 62/271,347, filed on Dec. 28, 2015.

(30) Foreign Application Priority Data

Mar. 23, 2016 (TW) ..... 105108904 A

(51) Int. Cl.

| | |
|---|---|
| ***H01H 3/12*** | (2006.01) |
| ***H01H 13/52*** | (2006.01) |
| ***H01H 13/10*** | (2006.01) |
| ***H01H 13/14*** | (2006.01) |

(52) U.S. Cl.

CPC ..... *H01H 13/52* (2013.01); *H01H 13/10* (2013.01); *H01H 13/14* (2013.01); *H01H 2221/04* (2013.01)

(58) Field of Classification Search

CPC ..... H01H 13/52; H01H 13/14; H01H 13/10; H01H 13/7065; H01H 2221/04; G06F 3/02; G06F 3/0202; G06F 3/0221

USPC ..... 200/341, 404; 341/32; 335/205; 345/168

See application file for complete search history.

(56) References Cited

U.S. PATENT DOCUMENTS

| | | | | |
|---|---|---|---|---|
| 8,970,331 | B2 * | 3/2015 | Chang | H01H 13/702 200/341 |
| 9,064,651 | B2 * | 6/2015 | Hsu | H01H 13/7065 |
| 9,099,261 | B2 * | 8/2015 | Hsu | H01H 13/7065 |
| 9,117,599 | B2 * | 8/2015 | Chen | H01H 3/12 |
| 9,236,204 | B2 * | 1/2016 | Hsu | H01H 13/14 |
| 9,236,205 | B2 * | 1/2016 | Hsu | H01H 13/52 |
| 9,343,247 | B2 * | 5/2016 | Hsu | H01H 13/20 |
| 9,396,893 | B2 * | 7/2016 | Yen | H01H 13/84 |

(Continued)

*Primary Examiner* — Vanessa Girardi

(74) *Attorney, Agent, or Firm* — Winston Hsu

(57) ABSTRACT

A keyswitch includes a board, a cap, and a support device disposed between the board and the cap. A first abutting side of a first support member of the support device has a first hole formed toward a first bending arm of the board. The first bending arm is disposed through the first hole for pressing the first abutting side to abut against the board. The first abutting side has a second magnetic portion formed toward the second support member. A support portion extends from a second abutting side of the second support member toward the first support member for supporting the second magnetic portion. When the cap is pressed to make the second magnetic portion separate from a first magnetic portion of the board with rotation of the first and second support members relative to the first and second abutting sides, the cap moves to a pressed position.

22 Claims, 7 Drawing Sheets

(56) References Cited

U.S. PATENT DOCUMENTS

| | | | | |
|---|---|---|---|---|
| 9,411,475 | B2 * | 8/2016 | Chang | G06F 3/044 |
| 9,412,535 | B2 * | 8/2016 | Hsu | H01H 13/14 |
| 9,508,505 | B2 * | 11/2016 | Hsu | H01H 3/125 |

* cited by examiner

KEYSWITCH USING MAGNETIC FORCE TO RESTORE CAP POSITION

CROSS REFERENCE TO RELATED APPLICATIONS

This application claims the benefits of U.S. Provisional Applications No. 62/271,347, which was filed on Dec. 28, 2015, and are incorporated herein by reference.

BACKGROUND OF THE INVENTION

1. Field of the Invention

The present invention relates to a keyswitch and a keyboard thereof, and more specifically, to a keyswitch utilizing a magnetic attraction force between a support member and a board for driving a cap to return to its original position and a keyboard thereof.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

A conventional keyswitch usually utilizes assembly of a scissor support device and an elastic member to provide a cap with an elastic force for driving the cap return to a non-pressed position. However, since the scissor mechanical design adopted by the scissor support device requires more space so as to further increase the overall height of the keyswitch, it is disadvantageous to the thinning design of the keyswitch. Furthermore, because the elastic member is usually made of rubber material, elastic fatigue of the elastic member may occur after the elastic member is used over a long period of time so as to shorten the life of the keyswitch.

SUMMARY OF THE INVENTION

The present invention provides a keyswitch including a board, a cap, and a support device. The board has a first magnetic portion and at least one first bending arm. The support device is disposed between the board and the cap and includes a first support member and a second support member. A second magnetic portion extends from a first abutting side of the first support member toward the second support member corresponding to the first magnetic portion. A first hole extends from the first abutting side of the first support member toward the at least one first bending arm. The at least one first bending arm is disposed through the first hole for pressing the first abutting side via the first hole to abut against the board. A support portion extends from a second abutting side of the second support member toward the first support member to support the second magnetic portion. When the cap is not pressed, a magnetic attraction force between the second magnetic portion and the first magnetic portion keeps the cap at a non-pressed position. When the cap is pressed by an external force to make the second magnetic portion separate from the first magnetic portion with rotation of the first support member relative to the first abutting side and rotation of the second support member relative to the second abutting side and to keep the support portion tilted, the cap moves from the non-pressed position to a pressed position with the support device. When the external force is released, the magnetic attraction force makes the second magnetic portion approach the first magnetic portion, so as to make the cap move from the pressed position to the non-pressed position with the support device.

The present invention further provides a keyboard including a board and a plurality of keyswitches. The board has a first magnetic portion and at least one first bending arm. The plurality of keyswitches is disposed on the board. At least one of the plurality of keyswitches includes a cap and a support device. The support device is disposed between the board and the cap and includes a first support member and a second support member. A second magnetic portion extends from a first abutting side of the first support member toward the second support member corresponding to the first magnetic portion. A first hole extends from the first abutting side of the first support member toward the at least one first bending arm. The at least one first bending arm is disposed through the first hole for pressing the first abutting side via the first hole to abut against the board. A support portion extends from a second abutting side of the second support member toward the first support member to support the second magnetic portion. When the cap is not pressed, a magnetic attraction force between the second magnetic portion and the first magnetic portion keeps the cap at a non-pressed position. When the cap is pressed by an external force to make the second magnetic portion separate from the first magnetic portion with rotation of the first support member relative to the first abutting side and rotation of the second support member relative to the second abutting side and to keep the support portion tilted, the cap moves from the non-pressed position to a pressed position with the support device. When the external force is released, the magnetic attraction force makes the second magnetic portion approach the first magnetic portion, so as to make the cap move from the pressed position to the non-pressed position with the support device.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
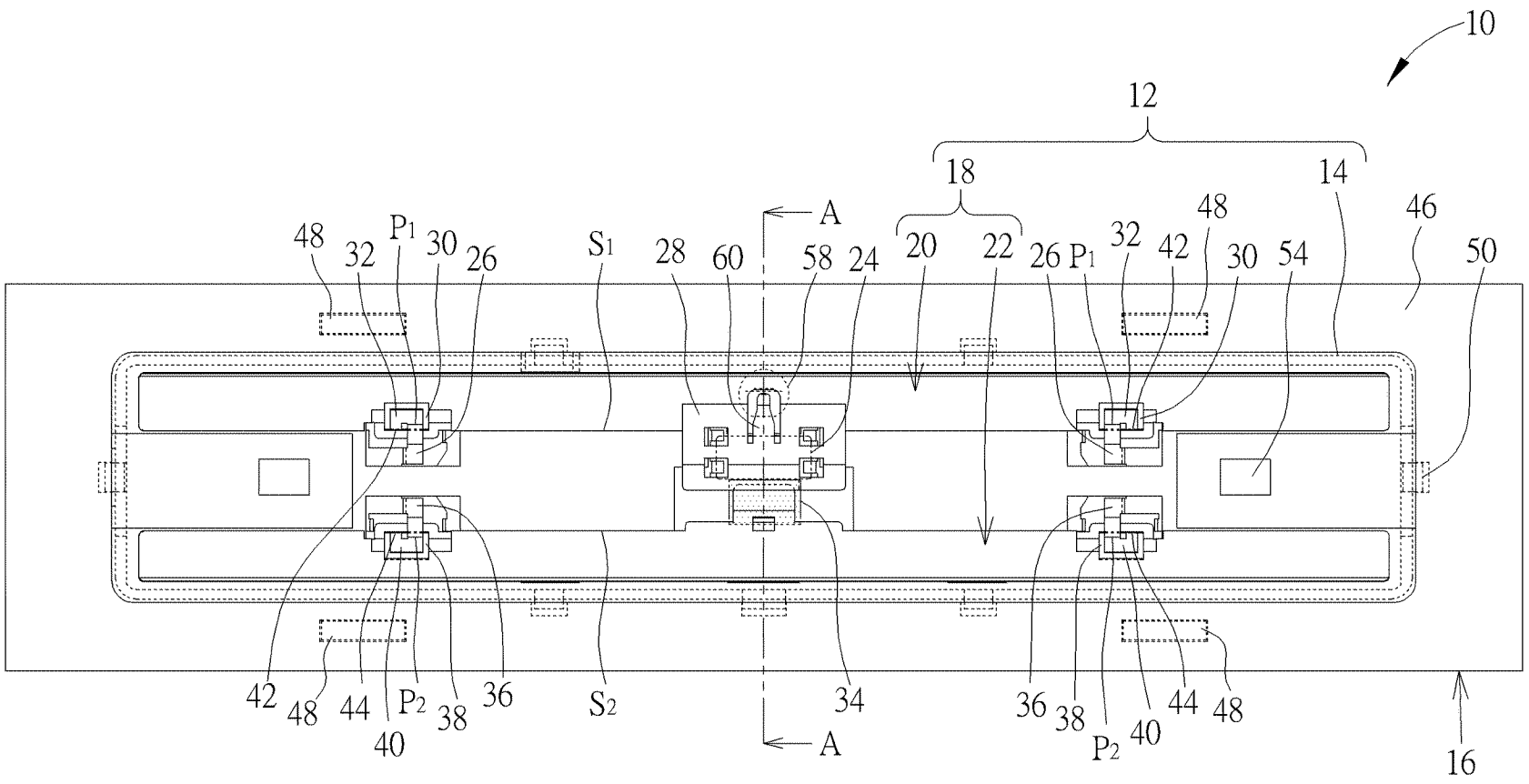
FIG. 1 is a partial top view of a keyboard according to an embodiment of the present invention.
Figure 2:
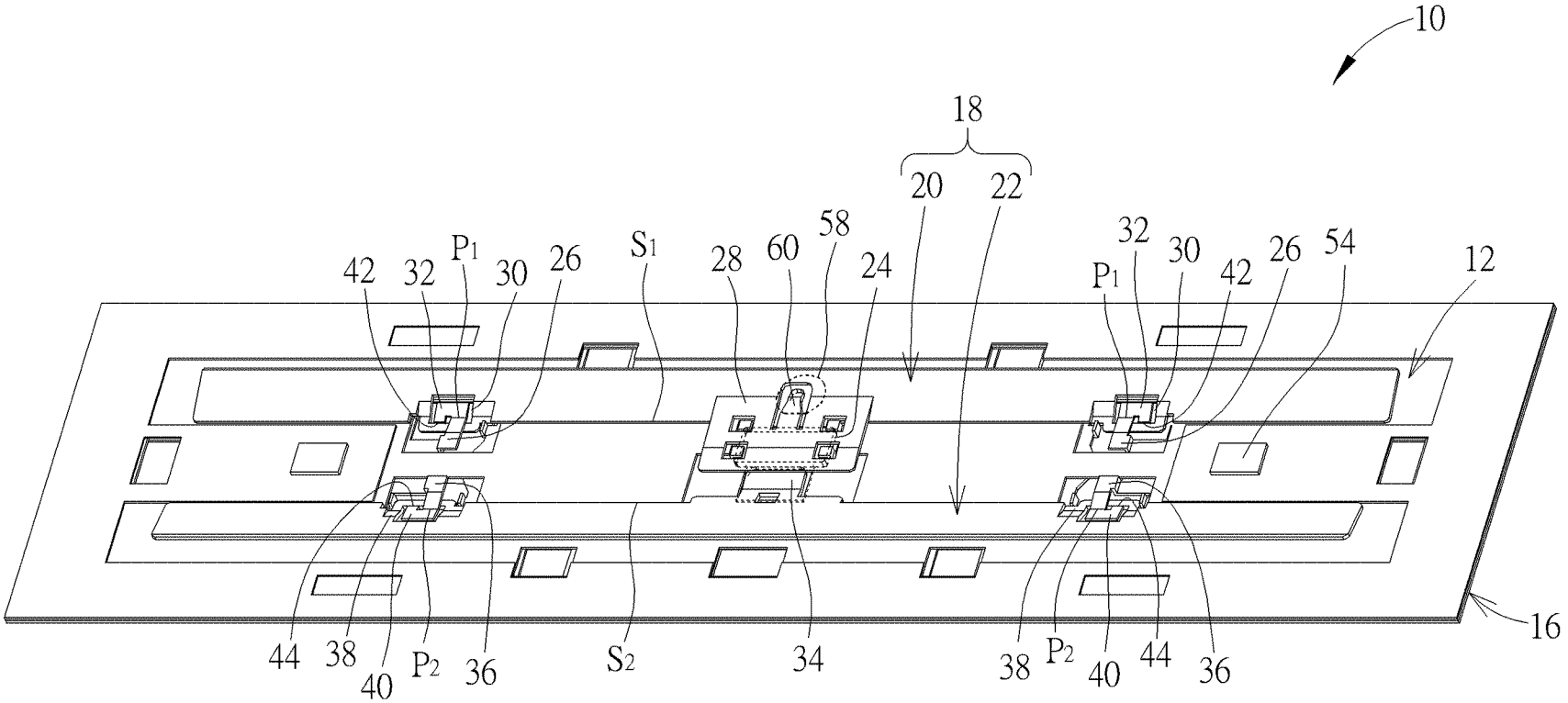
FIG. 2 is a diagram of the keyboard in FIG. 1.

Please refer to FIG. 1 and FIG. 2. FIG. 1 is a partial top view of a keyboard 10 according to an embodiment of the present invention. FIG. 2 is a diagram of the keyboard 10 in FIG. 1. For clearly showing the mechanical design of a keyswitch 12, a cap 14 is briefly depicted by dotted lines in FIG. 1 and the cap 14 and a limiting frame 46 are omitted in FIG. 2. As shown in FIG. 1 and FIG. 2, the keyboard 10 includes a plurality of keyswitches 12 (only one keyswitch 12 shown in FIG. 1 and FIG. 2, but not limited thereto) and a board 16. The plurality of keyswitches 12 is disposed on the board 16 for a user to perform input operations. The keyboard 10 could be preferably a keyboard conventionally applied to a personal computer, but not limited thereto. For example, the keyboard 10 could also be applied to a portable electronic device with a foldable mechanism composed of an upper cover and a lower casing (e.g. a notebook or a foldable keyboard device).

The magnetic attraction design adopted by the present invention could be applied to at least one of the plurality of keyswitches 12. In the following, more detailed description for only one keyswitch 12 to which the aforesaid design is applied is provided. As for the related description for the other keyswitches 12 utilizing the same design, it could be reasoned by analogy. As shown in FIG. 1 and FIG. 2, the keyswitch 12 includes the cap 14 and a support device 18. The support device 18 is disposed between the cap 14 and the board 16 and includes a first support member 20 and a second support member 22. The first support member 20 and the second support member 22 are pivoted to the board 16 respectively and abut against the cap 14 respectively, so that the cap 14 could move between a non-pressed position and a pressed position with the support device 18.

To be more specific, the board 16 has a first magnetic portion 24 (briefly depicted by dotted lines in FIG. 1 and FIG. 2) and at least one first bending arm 26 (two shown in FIG. 1 and FIG. 2 respectively, but not limited thereto). A second magnetic portion 28 extends from a first abutting side $S_1$ of the first support member 20 toward the second support member 22 corresponding to the first magnetic portion 24. A first hole 30 extends from the first abutting side $S_1$ of the first support member 20 toward the first bending arm 26, so that the first bending arm 26 could be disposed through the first hole 30 for pressing the first abutting side $S_1$ via the first hole 30 to abut against the board 16. In this embodiment, the first bending arm 26 could be preferably L-shaped (but not limited thereto), and a bending limiting portion 32 extends from a free end $P_1$ of the first bending arm 26 laterally and downwardly. The first hole 30 could be preferably recessed from the first abutting side $S_1$ (as shown in FIG. 2), so as to make an abutting position where the first bending arm 26 contacts with the first hole 30 collinear with the first abutting side $S_1$. Accordingly, the first support member 20 could rotate relative to the board 16 more steadily, so as to improve the tactile feeling and movement stability of the keyswitch 12. Furthermore, a support portion 34 extends from a second abutting side $S_2$ of the second support member 22 toward the first support member 20 for supporting the second magnetic portion 28.

The board 16 could further have at least one second bending arm 36 (two shown in FIG. 1 and FIG. 2 respectively, but not limited thereto). A second hole 38 extends from the second abutting side $S_2$ of the second support member 22 toward the second bending arm 36, so that the second bending arm 36 could be disposed through the second hole 38 for pressing the second abutting side $S_2$ via the second hole 36 to abut against the board 16. In this embodiment, the second bending arm 36 could be preferably L-shaped (but not limited thereto), and a bending limiting portion 40 extends from a free end $P_2$ of the second bending arm 36 laterally and downwardly. The second hole 38 could be preferably recessed from the second abutting side $S_2$ (as shown in FIG. 2), so as to make an abutting position where the second bending arm 36 contacts with the second hole 38 collinear with the second abutting side $S_2$. Accordingly, the second support member 22 could rotate relative to the board 16 more steadily, so as to improve the tactile feeling and movement stability of the keyswitch 12.

In such a manner, when the first hole 30 of the first support member 20 is pushed toward the first bending arm 26 to make the first bending arm 26 project into the first hole 30, the bending limiting portion 32 abuts against an inner hole edge 42 of the first hole 30 for limiting movement of the first support member 20 relative to the board 16, so as to make the first support member 20 detachably connected to the board 16. Simultaneously, the first bending arm 26 presses the first hole 30 to make the first abutting side $S_1$ of the first support member 20 abut against the board 16 firmly. Accordingly, the problem that the first abutting side $S_1$ could be lifted with rotation of the first support member 20 relative to the board 16 so as to increase the pressing stroke of the cap 14 during the cap 14 is pressed by an external force could be efficiently solved, so as to improve the tactile feeling and pressing sensitivity of the keyswitch 12.

Similarly, when the second hole 38 of the second support member 22 is pushed toward the second bending arm 36 to make the second bending arm 36 project into the second hole 38, the bending limiting portion 40 abuts against an inner hole edge 44 of the second hole 38 for limiting movement of the second support member 22 relative to the board 16, so as to make the second support member 22 detachably connected to the board 16. Simultaneously, the second bending arm 36 presses the second hole 38 to make the second abutting side $S_2$ of the second support member 22 abut against the board 16 firmly. Accordingly, the problem that the second abutting side $S_2$ could be lifted with rotation of the second support member 22 relative to the board 16 so as to increase the pressing stroke of the cap 14 during the cap 14 is pressed by an external force could be efficiently solved, so as to improve the tactile feeling and pressing sensitivity of the keyswitch 12.

Via the aforesaid design, the cap 14 could move between a non-pressed position and a pressed position relative to the board 16 with pivoting of the first support member 20 taking the first abutting side $S_1$ as a pivoting axis and the second support member 22 taking the second abutting side $S_2$ as a pivoting axis. To be noted, the keyboard of the present invention could adopt other designs for making the support member pivoted to the board (e.g. a shaft-hole fitting design) to replace the second bending arm 36 and the second hole 38, so as to improve the design flexibility of the keyboard in making the support device pivoted to the board.

Figure 3:
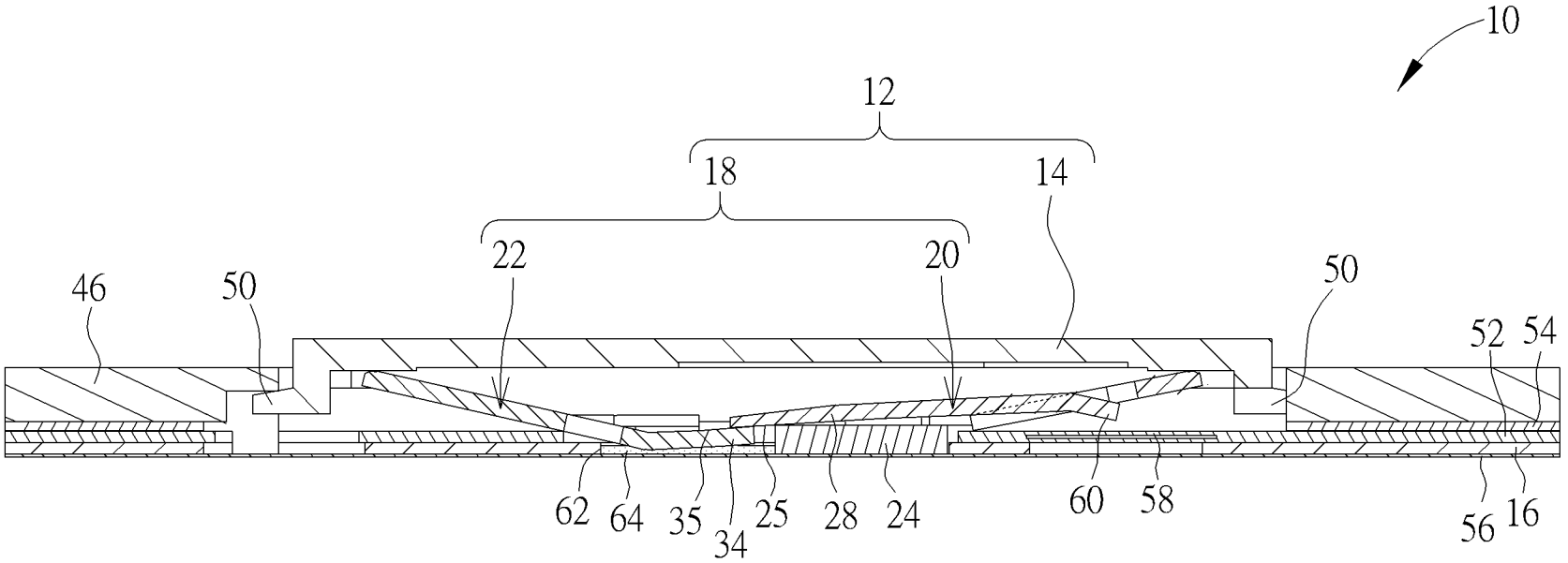
FIG. 3 is a sectional diagram of the keyboard in FIG. 1 along a sectional line A-A.

Furthermore, please refer to FIG. 1, FIG. 2 and FIG. 3. FIG. 3 is a sectional diagram of the keyboard 10 in FIG. 1 along a sectional line A-A. As shown in FIG. 1, FIG. 2 and FIG. 3, the board 16 could further have a limiting frame 46. In this embodiment, the limiting frame 46 has at least one magnet member 48 (four briefly depicted by dotted lines in FIG. 1 and FIG. 2, but not limited thereto) and the board 16 is made of magnetic material, so that the magnet member 48 could magnetically attract the board 16 to position the limiting frame 46 on the board 16 for improving assembly convenience of the keyswitch 12. Moreover, the cap 14 could have at least one ear portion 50 (seven shown in FIG. 1, but not limited thereto) extending toward the limiting frame 46, so that the limiting frame 46 could block the ear portion 50 to limit a height of the cap 14 relative to the board 16. In practical application, as shown in FIG. 3, a surface 25 of the second magnetic portion 28 contacting with the first magnetic portion 24 is a planar surface, but not limited thereto, meaning that the surface 25 could be a recessed curve surface or a recessed bending surface in another embodiment. Similarly, a surface 35 of the support portion 34 contacting with the second magnetic portion 28 could be a planar surface, but not limited thereto, meaning that the surface 35 of the support portion 34 could be a recessed curve surface or a recessed bending surface in another embodiment.

In this embodiment, the first magnetic portion 24 could be preferably a magnet, and the second magnetic portion 28 could be preferably a magnet or be made of magnetic material (e.g. iron or other metal material). In another embodiment, the first magnetic portion 24 could be made of magnetic material (e.g. iron or other metal material), and the second magnetic portion 28 could be a magnet.

Figure 4:
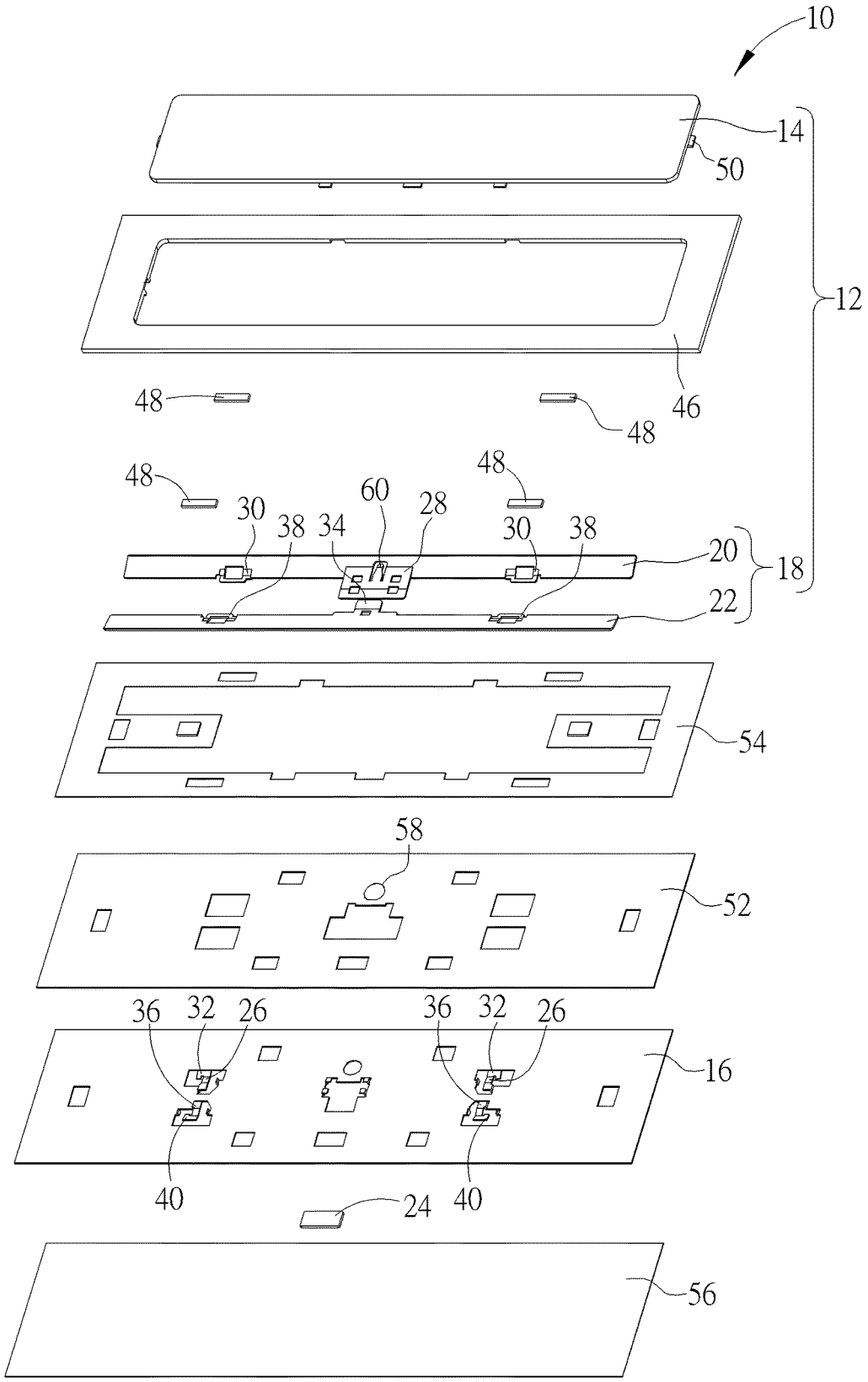
FIG. 4 is an exploded diagram of the keyboard in FIG. 1.

Please refer to FIG. 4, which is an exploded diagram of the keyboard 10 in FIG. 1. As shown in FIG. 4, the keyboard 10 could further include a circuit board 52, an LED (Light Emitting Diode) layer 54, and a thin film layer 56 (e.g. a mylar layer). The circuit board 52 is disposed on the board 16 and could be preferably a membrane and have a switch 58 (e.g. a membrane switch or other triggering switch), and the first support member 20 could further have a triggering arm 60 for triggering the switch 58. The LED layer 54 is disposed between the support device 18 and the circuit board 52 for emitting light to the keyswitch 12. Compared with the light emitting design that an LED and a light guide plate are disposed under a keyboard for emitting light to each keyswitch, the aforesaid design that the LED layer 54 is disposed under each keyswitch 12 respectively could generate the power saving effect. The thin film layer 56 is attached under the board 16 for supporting the first magnetic portion 24 and providing a waterproof function.

Figure 5:
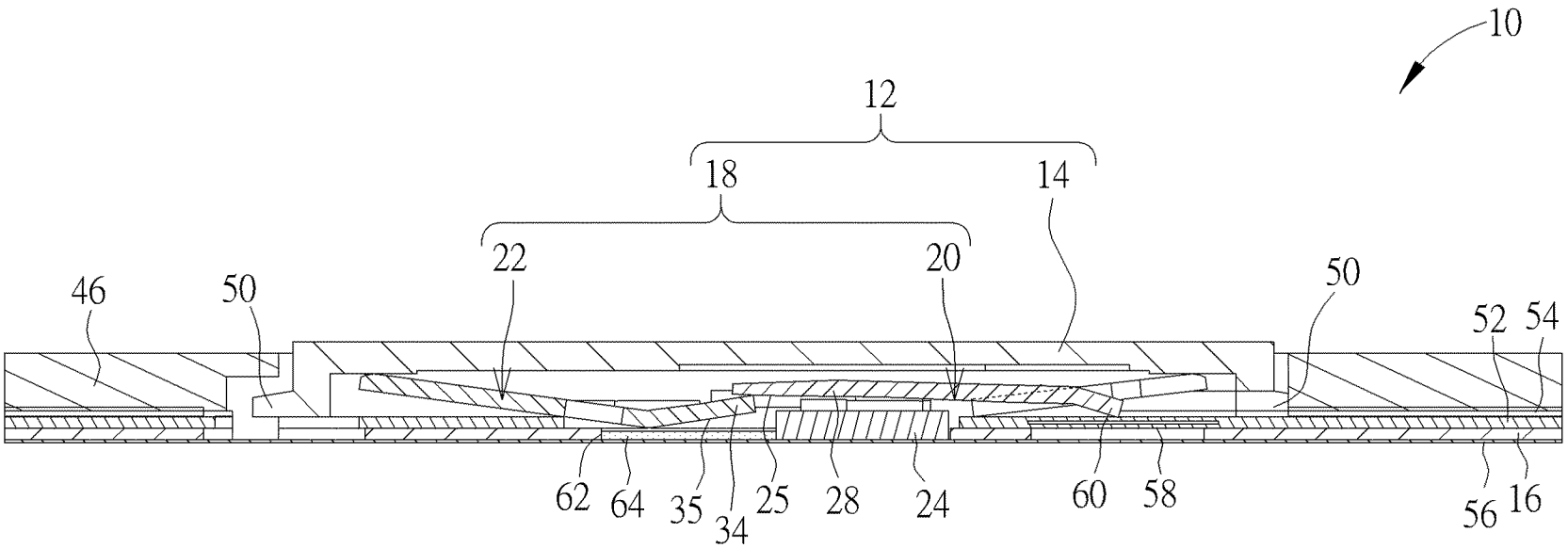
FIG. 5 is a sectional diagram of a cap in FIG. 3 being pressed to a pressed position.

Via the aforesaid design, the magnetic attraction force between the second magnetic portion 28 and the first magnetic portion 24 could keep the cap 14 at the non-pressed position as shown in FIG. 3 when the cap 14 is not pressed. When the cap 14 is pressed by an external force and the external force could overcome the magnetic attraction force between the second magnetic portion 28 and the first magnetic portion 24 (as shown in FIG. 5), the cap 14 presses the first support member 20 and the second support member 22 to make the second magnetic portion 28 separate from the first magnetic portion 24 and to keep the support portion 34 tilted, so as to make the triggering arm 60 trigger the switch 58 of the circuit board 52 for executing the corresponding input function. Furthermore, as shown in FIG. 5, during the second magnetic portion 28 is separate from the first magnetic portion 24, the magnetic attraction force between the second magnetic portion 28 and the first magnetic portion 24 could still magnetically attract the first support member 20 for making the triggering arm 60 trigger the switch 58 of the circuit board 52 surely, so that electrical signals generated by the circuit board 52 could be more stable.

On the other hand, when the cap 14 is released, the magnetic attraction force between the second magnetic portion 28 and the first magnetic portion 24 magnetically attracts the second magnetic portion 28 to be absorbed onto the first magnetic portion 24, so as to drive the cap 14 to move from the pressed position as shown in FIG. 5 back to the non-pressed position as shown in FIG. 3 for achieving the purpose that the keyswitch 12 could automatically return to its original position.

To be noted, as shown in FIG. 3 and FIG. 5, the board 16 could further have a containing slot 62 formed under the support portion 34, and a buffer member 64 (e.g. damping oil or rubber) disposed in the containing slot 62. Accordingly, the buffer member 64 could provide a buffer to the support portion 34 during the magnetic attraction force between the second magnetic portion 28 and the first magnetic portion 24 magnetically attracts the second magnetic portion 28 to be absorbed onto the first magnetic portion 24, so as to reduce noise caused by the second magnetic portion 28 colliding with the first magnetic portion 24. Moreover, the support portion 34 could be preferably made of magnetic material so that the support portion 34 could be magnetized by the magnetic attraction force between the second magnetic portion 28 and the first magnetic portion 24 and could be accordingly absorbed onto the second magnetic portion 28, for ensuring that the second support member 22 could move together with the second magnetic portion 28 of the first support member 20.

Figure 6:
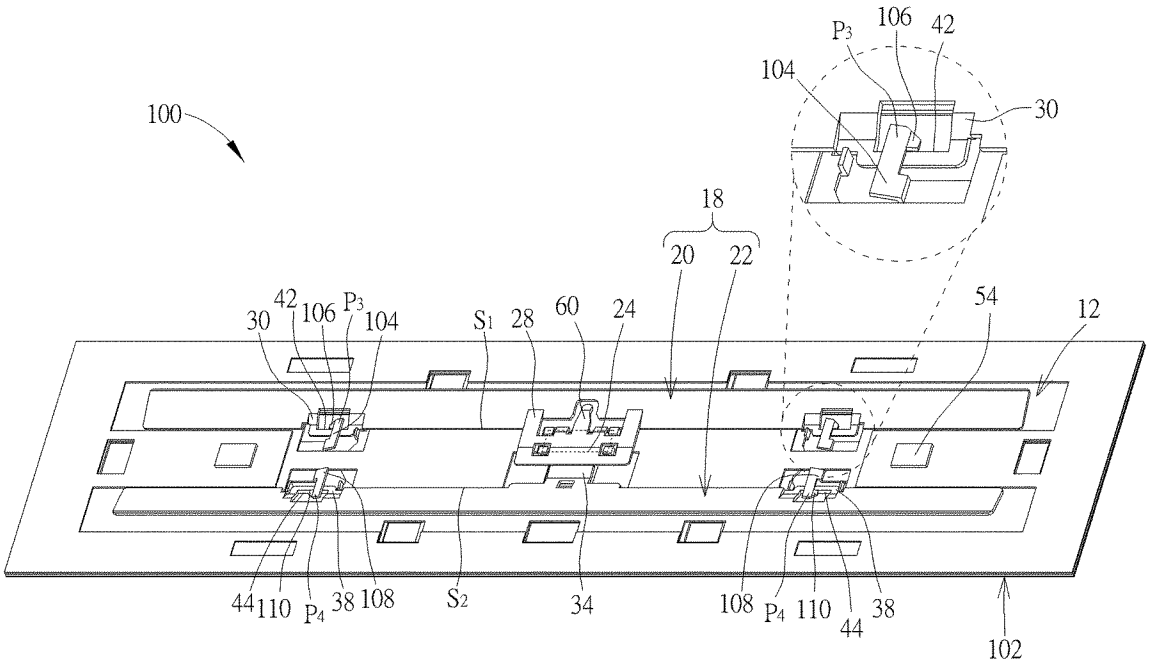
FIG. 6 is a partial enlarged diagram of a keyboard according to another embodiment of the present invention.

Please refer to FIG. 6, which is a partial enlarged diagram of a keyboard 100 according to another embodiment of the present invention. For clearly showing the mechanical design of the keyswitch 12 and a board 102, the cap 14 and the limiting frame 46 are omitted in FIG. 6. Components both mentioned in this embodiment and the aforesaid embodiment represent components with similar structures or functions, and the related description is omitted herein. The major difference between the keyboard 10 and the keyboard 100 is the structural design of the board 102. As shown in FIG. 6, the keyboard 100 includes the plurality of keyswitches 12 (only one keyswitch 12 shown in FIG. 6, but not limited thereto) and the board 102. The board 102 has the first magnetic portion 24 (briefly depicted by dotted lines in FIG. 6) and at least one first bending arm 104 (two shown in FIG. 6, but not limited thereto) protruding therefrom. The second magnetic portion 28 extends from the first abutting side $S_1$ of the first support member 20 toward the second support member 22 corresponding to the first magnetic portion 24. In this embodiment, the first bending arm 104 could be preferably L-shaped (but not limited thereto), and an inclined limiting portion 106 could extend from a free end $P_3$ of the first bending arm 104 laterally and downwardly. The board 102 could further have a second bending arm 108 protruding therefrom. In this embodiment, the second bending arm 108 could be preferably L-shaped (but not limited thereto), and an inclined limiting portion 110 could extend from a free end $P_4$ of the second bending arm 108 laterally and downwardly.

In such a manner, when the first hole 30 of the first support member 20 is pushed toward the first bending arm 104 to make the first bending arm 104 project into the first hole 30, the inclined limiting portion 106 could abut against the inner hole edge 42 of the first hole 30 to limit movement of the first support member 20 relative to the board 102, so as to make the first support member 20 detachably connected to the board 102. Simultaneously, the first bending arm 104 presses the first hole 30 to make the first abutting side $S_1$ of the first support member 20 abut against the board 102 firmly. Accordingly, the first support member 20 could take the first abutting side $S_1$ as a pivoting shaft to be pivoted to the board 102.

Similarly, when the second hole 38 of the second support member 22 is pushed toward the second bending arm 108 to make the second bending arm 108 project into the second hole 38, the inclined limiting portion 110 abuts against the inner hole edge 44 of the second hole 38 for limiting movement of the second support member 22 relative to the board 102, so as to make the second support member 22 detachably connected to the board 102. Simultaneously, the second bending arm 108 presses the second hole 38 to make the second abutting side $S_2$ of the second support member 22 abut against the board 102 firmly. Accordingly, the second support member 22 could take the second abutting side $S_2$ as a pivoting shaft to be pivoted to the board 102.

Via the aforesaid design, the cap 14 could move between the non-pressed position and the pressed position relative to the board 102 with pivoting of the first support member 20 and the second support member 22. As for the other related description for the keyboard 100, it could be reasoned by analogy according to the aforesaid embodiment and omitted herein.

Figure 7:
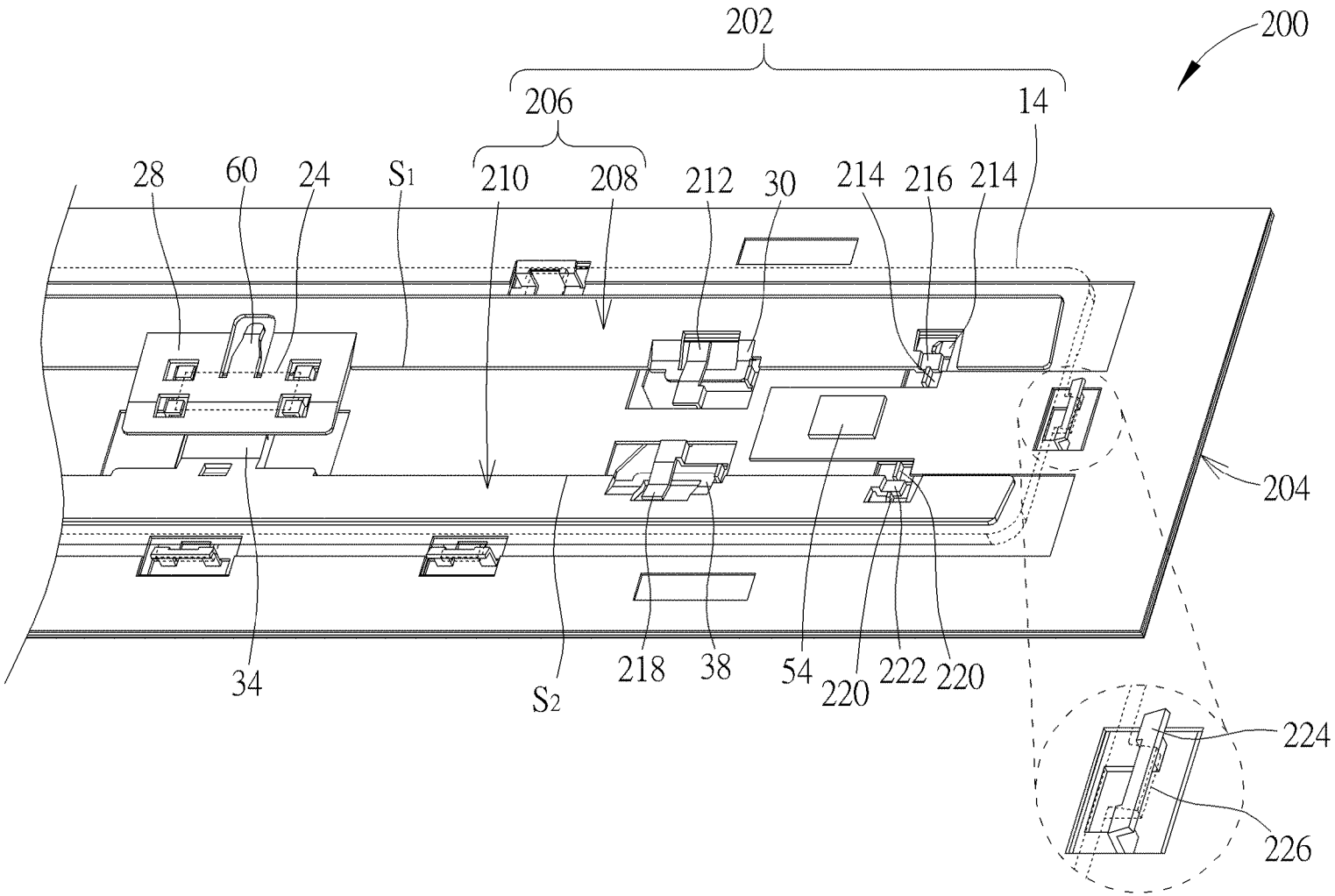
FIG. 7 is a partial enlarged diagram of a keyboard according to another embodiment of the present invention.

Please refer to FIG. 7, which is a partial enlarged diagram of a keyboard 200 according to another embodiment of the present invention. For clearly showing the mechanical design of a keyswitch 202 and a board 204, the cap 14 is briefly depicted by dotted lines in FIG. 7. Components both mentioned in this embodiment and the aforesaid embodiments represent components with similar structures or functions, and the related description is omitted herein. As shown in FIG. 7, the keyboard 200 includes a plurality of keyswitches 202 (only one keyswitch 202 shown in FIG. 7, but not limited thereto) and the board 204. The keyswitch 202 includes the cap 14 and a support device 206. The support device 206 is disposed between the cap 14 and the board 204 and includes a first support member 208 and a second support member 210. The board 204 has the first magnetic portion 24 (briefly depicted by dotted lines in FIG. 7), at least one first bending arm 212 (one shown in FIG. 7, but not limited thereto), and two bending sheet members 214 spaced apart. In this embodiment, the first bending arm 212 could be preferably L-shaped (but not limited thereto), and a bending limiting arm 216 (preferably step-shaped, but not limited thereto) extends from the first abutting side $S_1$ of the first support member 208 toward the two bending sheet members 214. Furthermore, the board 204 could further have a second bending arm 218 protruding therefrom and two bending sheet members 220 spaced apart. In this embodiment, the second bending arm 218 could be preferably L-shaped (but not limited thereto), and a bending limiting arm 222 (preferably step-shaped, but not limited thereto) extends from the second abutting side $S_2$ of the second support member 210 toward the two bending sheet members 220.

In such a manner, when the first hole 30 of the first support member 208 is pushed toward the first bending arm 212 to make the first bending arm 212 project into the first hole 30, the bending limiting arm 216 is inserted between the two bending sheet members 214 to limit movement of the first support member 208 relative to the board 204, so as to make the first support member 208 detachably connected to the board 204. Simultaneously, the first bending arm 212 presses the first hole 30 to make the first abutting side $S_1$ of the first support member 208 abut against the board 204 firmly. Accordingly, the first support member 208 could take the first abutting side $S_1$ as a pivoting shaft to be pivoted to the board 204.

Similarly, when the second hole 38 of the second support member 210 is pushed toward the second bending arm 218 to make the second bending arm 218 project into the second hole 38, the bending limiting arm 222 is inserted between the two bending sheet members 220 to limit movement of the second support member 210 relative to the board 204, so as to make the second support member 210 detachably connected to the board 204. Simultaneously, the second bending arm 218 presses the second hole 38 to make the second abutting side $S_2$ of the second support member 210 abut against the board 204 firmly. Accordingly, the second support member 210 could take the second abutting side $S_2$ as a pivoting shaft to be pivoted to the board 204.

Via the aforesaid design, the cap 14 could move between the non-pressed position and the pressed position relative to the board 204 with pivoting of the first support member 208 and the second support member 210. As for the other related description for the keyboard 200, it could be reasoned by analogy according to the aforesaid embodiment and omitted herein.

Furthermore, in this embodiment, the board 204 could further have at least one protruding limiting slot structure 224 (four shown in FIG. 7, but not limited thereto). The first support member 208 and the second support member 210 support the cap 14, and the cap 14 could have an ear portion 226 corresponding to the protruding limiting slot structure 224. Accordingly, the ear portion 226 could be inserted into the protruding limiting slot structure 224 for directly positioning the cap 14 on the board 204 without additional disposal of the limiting frame 46.

In summary, since there is no scissor mechanism and elastic member disposed in the keyboard provided by the present invention, the present invention could greatly reduce the overall space occupied by the keyswitch, so as to be advantageous to the thinning design of the keyboard and effectively prolong the life of the keyswitch.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a board having a first magnetic portion and at least one first bending arm;

a cap; and a support device disposed between the board and the cap and comprising a first support member and a second support member, a second magnetic portion extending from a first abutting side of the first support member toward the second support member corresponding to the first magnetic portion, a first hole extending from the first abutting side of the first support member toward the at least one first bending arm, the at least one first bending arm being disposed through the first hole for pressing the first abutting side via the first hole to abut against the board, a support portion extending from a second abutting side of the second support member toward the first support member to support the second magnetic portion;

wherein when the cap is not pressed, a magnetic attraction force between the second magnetic portion and the first magnetic portion keeps the cap at a non-pressed position; when the cap is pressed by an external force to make the second magnetic portion separate from the first magnetic portion with rotation of the first support member relative to the first abutting side and rotation of the second support member relative to the second abutting side and to keep the support portion tilted, the cap moves from the non-pressed position to a pressed position with the support device; when the external force is released, the magnetic attraction force makes the second magnetic portion approach the first magnetic portion, so as to make the cap move from the pressed position to the non-pressed position with the support device.

2. The keyswitch of claim 1, wherein a bending limiting portion extends from a free end of the at least one first bending arm laterally and downwardly, and when the at least one first bending arm is disposed through the first hole, the bending limiting portion abuts against an inner hole edge of the first hole to limit movement of the first support member relative to the board.

3. The keyswitch of claim 1, wherein an inclined limiting portion extending from a free end of the at least one first bending arm laterally and downwardly, and when the at least one first bending arm is disposed through the first hole, the inclined limiting portion abuts against an inner hole edge of the first hole to limit movement of the first support member relative to the board.

4. The keyswitch of claim 1, wherein two bending sheet members are spaced apart on the board, a limiting arm extends from the first abutting side of the first support member toward the two bending sheet members, and when the at least one first bending arm is disposed through the first hole, the limiting arm is inserted between the two bending sheet members to limit movement of the first support member relative to the board.

5. The keyswitch of claim 1, wherein the first hole is recessed from the first abutting side, so as to make an abutting position where the at least one first bending arm contacts with the first hole collinear with the first abutting side.

6. The keyswitch of claim 1, wherein the board further has at least one protruding limiting slot structure, the first support member and the second support member support the cap, the cap has an ear portion corresponding to the at least one protruding limiting slot structure, and the ear portion is inserted into the protruding limiting slot structure for positioning the cap on the board.

7. The keyswitch of claim 1, wherein the board further has a containing slot and a buffer member, the containing slot is formed under the support portion, the buffer member is disposed in the containing slot for providing a buffer to the support portion.

8. The keyswitch of claim 1, wherein the board further has at least one second bending arm, a second hole extends from the second abutting side of the second support member toward the at least one second bending arm, and the at least one second bending arm is disposed through the second hole for pressing the second abutting side via the second hole to abut against the board.

9. The keyswitch of claim 1, wherein the support portion is made of magnetic material.

10. The keyswitch of claim 1, wherein the board further has a limiting frame, the cap is movably disposed through the limiting frame, the cap has at least one ear portion extending toward the limiting frame, and the limiting frame blocks the at least one ear portion to limit a height of the cap relative to the board.

11. The keyswitch of claim 10, wherein the limiting frame has at least one magnet member, the board is made of magnetic material, and the at least one magnet member magnetically attracts the board to position the limiting frame on the board.

12. A keyboard comprising:

a board having a first magnetic portion and at least one first bending arm; and a plurality of keyswitches disposed on the board, at least one of the plurality of keyswitches comprising:

a cap; and a support device disposed between the board and the cap and comprising a first support member and a second support member, a second magnetic portion extending from a first abutting side of the first support member toward the second support member corresponding to the first magnetic portion, a first hole extending from the first abutting side of the first support member toward the at least one first bending arm, the at least one first bending arm being disposed through the first hole for pressing the first abutting side via the first hole to abut against the board, a support portion extending from a second abutting side of the second support member toward the first support member to support the second magnetic portion;

wherein when the cap is not pressed, a magnetic attraction force between the second magnetic portion and the first magnetic portion keeps the cap at a non-pressed position; when the cap is pressed by an external force to make the second magnetic portion separate from the first magnetic portion with rotation of the first support member relative to the first abutting side and rotation of the second support member relative to the second abutting side and to keep the support portion tilted, the cap moves from the non-pressed position to a pressed position with the support device; when the external force is released, the magnetic attraction force makes the second magnetic portion approach the first magnetic portion, so as to make the cap move from the pressed position to the non-pressed position with the support device.

13. The keyboard of claim 12, wherein a bending limiting portion extends from a free end of the at least one first bending arm laterally and downwardly, and when the at least one first bending arm is disposed through the first hole, the bending limiting portion abuts against an inner hole edge of the first hole to limit movement of the first support member relative to the board.

14. The keyboard of claim 12, wherein an inclined limiting portion extending from a free end of the at least one first bending arm laterally and downwardly, and when the at least one first bending arm is disposed through the first hole, the inclined limiting portion abuts against an inner hole edge of the first hole to limit movement of the first support member relative to the board.

15. The keyboard of claim 12, wherein two bending sheet members are spaced apart on the board, a limiting arm extends from the first abutting side of the first support member toward the two bending sheet members, and when the at least one first bending arm is disposed through the first hole, the limiting arm is inserted between the two bending sheet members to limit movement of the first support member relative to the board.

16. The keyboard of claim 12, wherein the first hole is recessed from the first abutting side, so as to make an abutting position where the at least one first bending arm contacts with the first hole collinear with the first abutting side.

17. The keyboard of claim 12, wherein the board further has at least one protruding limiting slot structure, the first support member and the second support member support the cap, the cap has an ear portion corresponding to the at least one protruding limiting slot structure, and the ear portion is inserted into the protruding limiting slot structure for positioning the cap on the board.

18. The keyboard of claim 12, wherein the board further has a containing slot and a buffer member, the containing slot is formed under the support portion, the buffer member is disposed in the containing slot for providing a buffer to the support portion.

19. The keyboard of claim 12, wherein the board further has at least one second bending arm, a second hole extends from the second abutting side of the second support member toward the at least one second bending arm, and the at least one second bending arm is disposed through the second hole for pressing the second abutting side via the second hole to abut against the board.

20. The keyboard of claim 12, wherein the support portion is made of magnetic material.

21. The keyboard of claim 12, wherein the board further has a limiting frame, the cap is movably disposed through the limiting frame, the cap has at least one ear portion extending toward the limiting frame, and the limiting frame blocks the at least one ear portion to limit a height of the cap relative to the board.

22. The keyboard of claim 21, wherein the limiting frame has at least one magnet member, the board is made of magnetic material, and the at least one magnet member magnetically attracts the board to position the limiting frame on the board.

* * * * *